US005737797A

United States Patent [19]

Rittmueller et al.

[11] Patent Number: 5,737,797

[45] Date of Patent: Apr. 14, 1998

[54] CENTRAL VACUUM WITH ACOUSTICAL DAMPING

[75] Inventors: Stephen P. Rittmueller, St. Charles, Ill.; Douglas E. Johnson; Steven D. Lauritsen, both of Webster City, Iowa; J. Adin Mann, III; David K. Holger, both of Ames,, Iowa

[73] Assignees: Iowa State University Research Foundation, Inc., Ames, Iowa; White Consolidated Industries, Inc., Cleveland, Ohio

[21] Appl. No.: 563,287

[22] Filed: Nov. 28, 1995

[51] Int. Cl.[6] ..... A47L 5/38

[52] U.S. Cl. ..... 15/326; 15/314; 15/413; 55/276

[58] Field of Search ..... 15/326, 314, 327.1, 15/413; 55/276

[56] References Cited

U.S. PATENT DOCUMENTS

| | | | |
|---|---|---|---|
| 2,884,185 | 4/1959 | Dolan | 15/326 X |
| 3,358,316 | 12/1967 | Okun | 15/326 X |
| 3,882,961 | 5/1975 | Cannan et al. | 15/326 X |
| 4,015,683 | 4/1977 | Williams | 15/326 X |
| 4,356,591 | 11/1982 | Lude | 15/326 |
| 4,938,309 | 7/1990 | Emdy . | |
| 5,365,633 | 11/1994 | Sunagawa et al. | 15/326 |
| 5,400,463 | 3/1995 | Attard et al. | 15/327.1 X |

FOREIGN PATENT DOCUMENTS

| | | | |
|---|---|---|---|
| 113174 | 10/1978 | Japan | 15/326 |

*Primary Examiner*—Chris K. Moore

*Attorney, Agent, or Firm*—Pearne, Gordon, McCoy & Granger LLP

[57] ABSTRACT

A central vacuum unit having an acoustic damping system is provided. The central vacuum unit includes a canister having a sidewall forming a hollow interior and a lid closing an end of the sidewall, a vacuum motor within the canister which emits noise during operation, at least one cooling air inlet for admitting cooling air into the hollow interior, and at least one cooling air outlet in the sidewall for exhausting the cooling air from the hollow interior. Additionally, the sidewall has an exhaust port and the motor has an exhaust pipe extending through the exhaust port. The acoustic damping system includes an acoustic damping tunnel, an acoustic damping canopy, and an exhaust port seal. The acoustic damping tunnel is within the hollow interior and forms a pathway between the hollow interior and the cooling air outlet. The pathway is lined with a sound absorbing material so that the tunnel reduces noise emitted from the hollow interior through the cooling outlet. The acoustic damping canopy is attached to the canopy over the cooling air inlet. The canopy has an inlet and forms a serpentine pathway between the canister cooling air inlet and said canopy inlet to reduce noise emitted from the hollow interior through the canister cooling air inlet. The exhaust port seal covers the exhaust port to reduce noise emitted from the hollow interior through the exhaust port. The exhaust port seal preferably includes flexible foam bonded to the canister sidewall.

27 Claims, 4 Drawing Sheets

CENTRAL VACUUM WITH ACOUSTICAL DAMPING

BACKGROUND OF THE INVENTION

1. Field of the Invention

The present invention relates in general to a central vacuum unit and, more particularly, to an acoustical damping system which substantially reduces the level of noise emitted from the central vacuum unit.

2. Description of Related Art

Built in vacuum systems typically have a central vacuum unit and a system of vacuum ducts which extend into various rooms of the house. Vacuum inlets are located in walls of selected rooms so that a vacuum hose can be connected to the central vacuum unit. When not in use, the vacuum inlets are covered by plates. To use the central vacuum system, one of the vacuum inlets is opened and the vacuum hose is plugged into the inlet. The central vacuum unit is automatically activated and a suction force draws in dirt and dust through a nozzle attached to the end of the vacuum hose. The central vacuum system provides more cleaning power than conventional portable vacuum cleaners and reduces the necessity of carrying portable vacuum cleaners from room to room. Additionally, the central vacuum system vents exhaust air out of the living area to eliminate the recirculation of unhealthy air.

One major disadvantage of built in vacuum systems known in the prior art, however, is the creation of a substantial amount of noise by the central vacuum unit. In most conventional units known in the prior art, the noise level generated from the central vacuum unit lies in the range of about 75 to about 95 decibels. Even though the central vacuum unit is typically located in a remote area such as the basement or garage of the home, many people use such locations as playrooms, workshops, etc. It is almost impossible to comfortably work in such locations when the central power and suction unit is operating, because the high noise level is sometimes deafening and at best extremely irritating.

U.S. Pat. No. 4,938,309, the disclosure of which is expressly incorporated herein in its entirety by reference, discloses a built-in vacuum cleaning system with an acoustic damping design. The motors of the unit are enclosed within an interior chamber which includes at its lower end a baffle covered with acoustic foam and is vented through exhaust ports. Tips of the motor armatures are separated from the remainder of the armatures and motor by the baffle. The tips of the armatures extend into a separate acoustic damping chamber which is also covered at a lower end with acoustic foam and includes openings for cooling air. While this acoustic damping design may reduce the noise level emitted from the unit while sufficiently cooling the motor, the noise level remains relatively high. Accordingly., there is a need in the art for a built-in vacuum cleaning system with an improved acoustical damping system to significantly lower the noise level emitted from the central vacuum unit.

SUMMARY OF THE INVENTION

The present invention provides a central vacuum unit with an improved acoustic damping system which overcomes at least some of the above-noted problems. The central vacuum unit includes a canister which forms a hollow interior, a vacuum motor within the canister which emits noise during operation, at least one opening in the canister, and an acoustic damping tunnel within the hollow interior and forming a pathway between the hollow interior and the opening. The pathway is lined with a sound absorbing material so that the tunnel reduces noise emitted from the hollow interior through the opening.

According to another aspect of the invention, an acoustic damping canopy is attached to the outside of the canister and covers an opening in the canister. The canopy has at least one inlet and forms a serpentine pathway between the inlet and the opening in the canister to reduce noise emitted from the hollow interior through the opening in the canister.

According to yet another aspect of the invention the canister has an exhaust port and the motor has an exhaust pipe extending through the exhaust port. An exhaust port seal is provided which completely covers the exhaust port to reduce noise emitted from the hollow interior through the exhaust port. The exhaust port seal is preferably formed from flexible foam.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
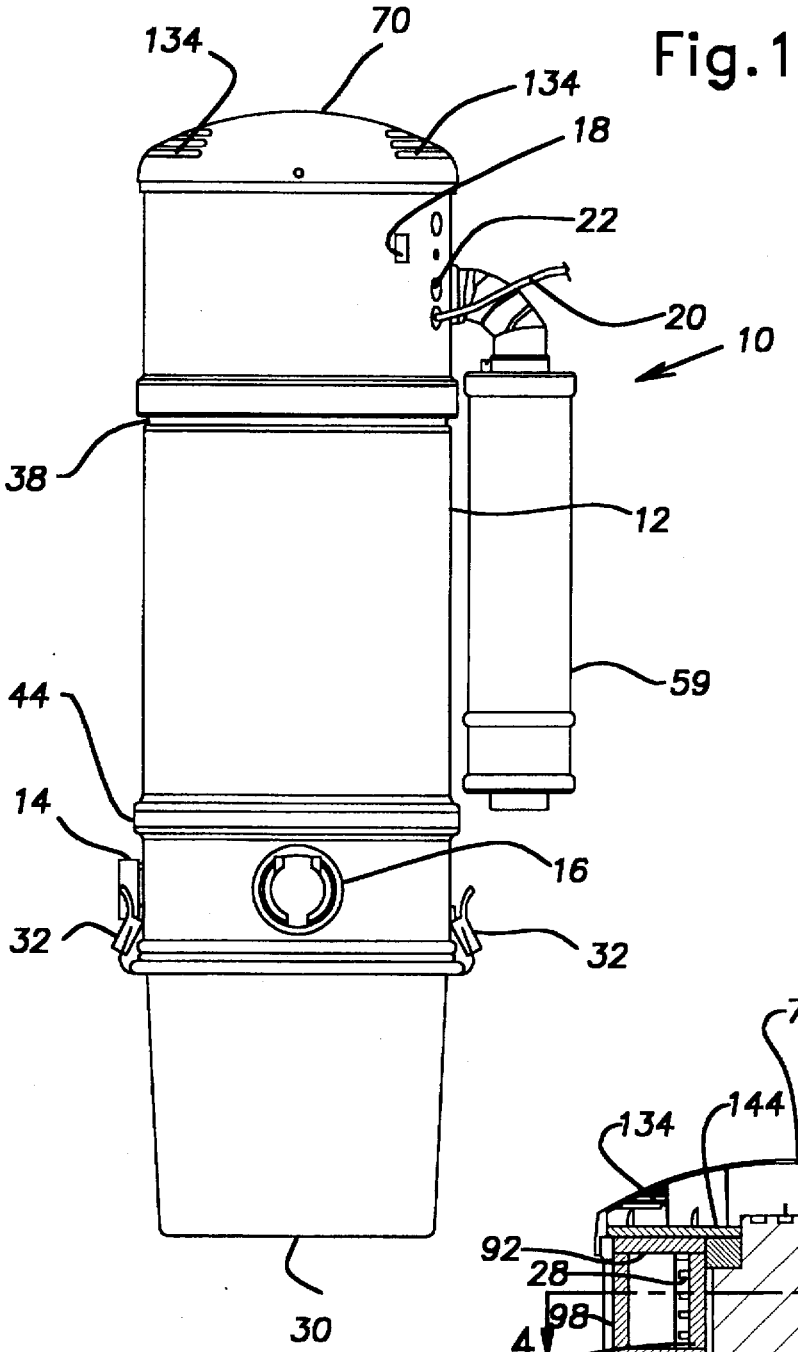
FIG. 1 is a front elevational view of a central vacuum unit according to the invention.
Figure 2:
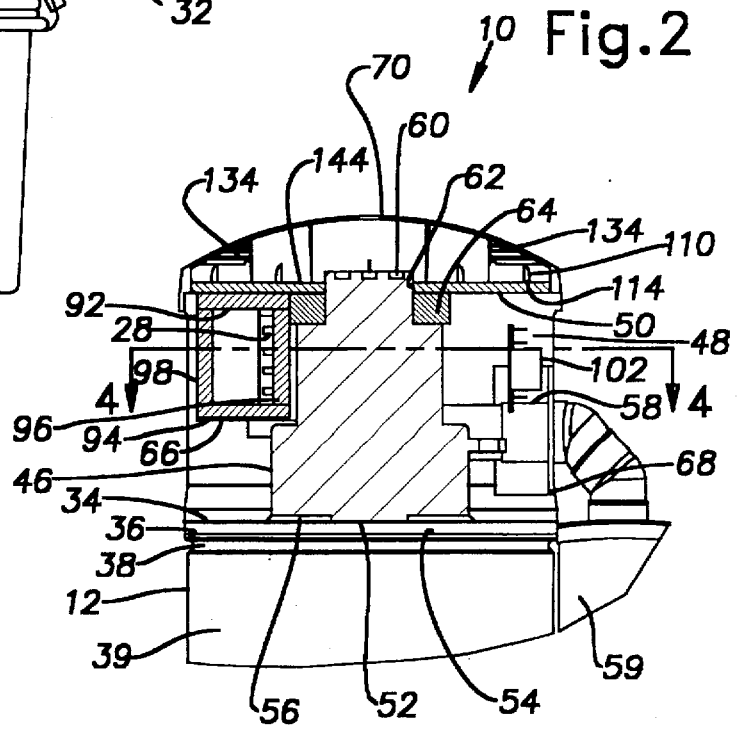
FIG. 2 is a fragmented and enlarged view, partially in cross-section, of a portion of the central vacuum unit of FIG. 1.
Figure 3:
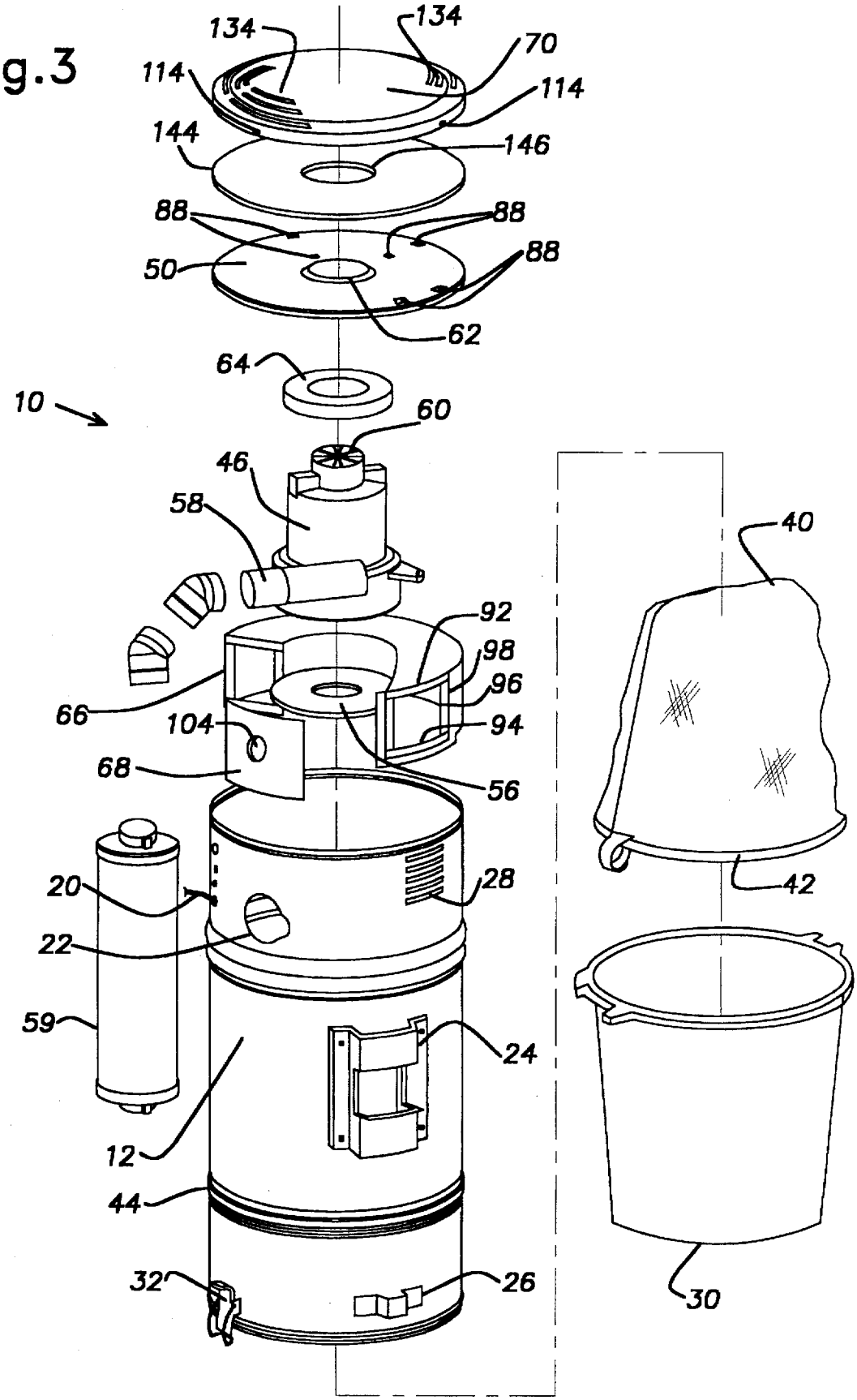
FIG. 3 is an exploded view of the central vacuum unit of FIG. 1.

FIGS. 1–3 illustrate a central vacuum unit 10 with an acoustical damping system according to the present invention. The illustrated unit 10 is a model 189 manufactured by Beam Industries of Webster City, Iowa. It is noted, however, that while the model 189 central vacuum unit is utilized herein to illustrate the present invention, any conventional central vacuum unit can include the present invention to reduce the amount of noise emitted therefrom.

The central vacuum unit 10 has a cylindrically-shaped housing or canister 12 of rolled steel which forms a hollow interior space. The canister has a side wall with an air intake port 14 and a vacuum hose port 16 located near the bottom of the canister 12. An on-off switch 18 is located near the top of the canister 12. A power cord 20 is provided for connecting the central vacuum unit 10 to a conventional electrical power source (not shown). An exhaust port 22 is also located near the top of the canister 12. Upper and lower mounting brackets 24, 26 are vertically aligned along a rear face of the sidewall and provide means for mounting the canister 12 on a wall. Located in the sidewall near the top of the canister 12 is a cooling air exhaust or outlet 28 such as the illustrated plurality of slots.

A hollow bucket 30 is removably attached to the bottom of the canister 12 by means such as quick-release clips 32.

Within the canister 12 is a partition wall 34 which is supported by a ledge 36 formed by an inwardly extending recess 38 formed in the sidewall of the canister 12. Together the sidewall of the canister 12, the bucket 30, and the partition wall 34 form a first or lower interior compartment or chamber 39 within the hollow interior of the canister 12. A removable dirt and dust collection bag 40 which is air permeable and is housed within the lower interior chamber 39. The bag 40 has a flexible rim 42 which rests within an outwardly extending recess 44 formed in the side wall of the canister 12.

A vacuum motor 46 is housed within a second or upper interior compartment or chamber 48 which is located above the lower interior chamber 39 and is separated from the lower interior chamber 39 by the partition wall 34. The upper interior chamber 48 is formed by the side wall of the canister 12, the partition wall 34, and a steel lid 50 which closes the upper end of the canister 12. A vacuum inlet 52 of the vacuum motor 46 is in fluid flow communication with the lower interior chamber 39 through an opening 54 in the partition wall 34. A gasket 56 is provided between the vacuum motor 46 and the partition wall 34 so that a seal is maintained between the lower and upper interior chambers 39, 48.

A vacuum exhaust pipe 58 of the vacuum motor 46 provides an exit for hot exhaust coming from the vacuum motor 46 and extends through the exhaust port 22 in the sidewall of the canister 12. The vacuum exhaust pipe 58 is connected to a muffler 59 which is located outside the canister 12. The muffler 59 is preferably of the type disclosed in co-pending application No. 08/546,116, filed on Oct. 20, 1995, for a "CENTRAL VACUUM CLEANER MUFFLER", by Steven P. Rittmueller, Douglas E. Johnson, J. Adin Mann III, and David K. Holger, Docket No. ISURF #01877I the disclosure of which is expressly incorporated in its entirety herein by reference.

Suction created by the vacuum motor 46 causes a flow of air into the air intakes 14, 16 of the canister 12, through the collection bag 40 within lower interior chamber 39 of the canister 12, and into the vacuum inlet 52 of the vacuum motor 46. The air is exhausted from the motor 46 through the exhaust pipe 58 and the muffler 59. Dirt, dust and other debris entrained within the flow of air is blocked by the collection bag 40 and settles in the bucket 30. When the bucket 30 is full of dirt, the snap clips 32 are opened and the bucket 30 is removed so that the bucket 30 can be emptied.

A cooling air inlet 60 of the vacuum motor 46 extends through an opening 62 in the lid 50 so that the cooling air inlet 60 of the vacuum motor 46 is in fluid flow communication with the exterior of the canister 12. A gasket 64 is provided between the vacuum motor 46 and the lid 50 to seal the opening 62 and also thermally isolate the vacuum motor 46 from the lid 50. Preferably, the gasket 64 comprises an open cell foam. A cooling air fan (not shown) of the vacuum motor 46 draws cooling air through the cooling air inlet 60 of the vacuum motor 46 and over the armatures of the vacuum motor 46. The cooling air flows over the armatures of the vacuum motor 46, into the upper interior chamber 48, and out the cooling air outlet 28.

The acoustic damping system reduces the amount of noise emitted from the upper interior chamber 48 through the cooling air outlet 28, the exhaust port 22, and the cooling air inlet 60. The acoustic damping system includes an acoustic damping tunnel 66, an exhaust port seal 68, and an acoustic damping canopy 70.

Figure 4:
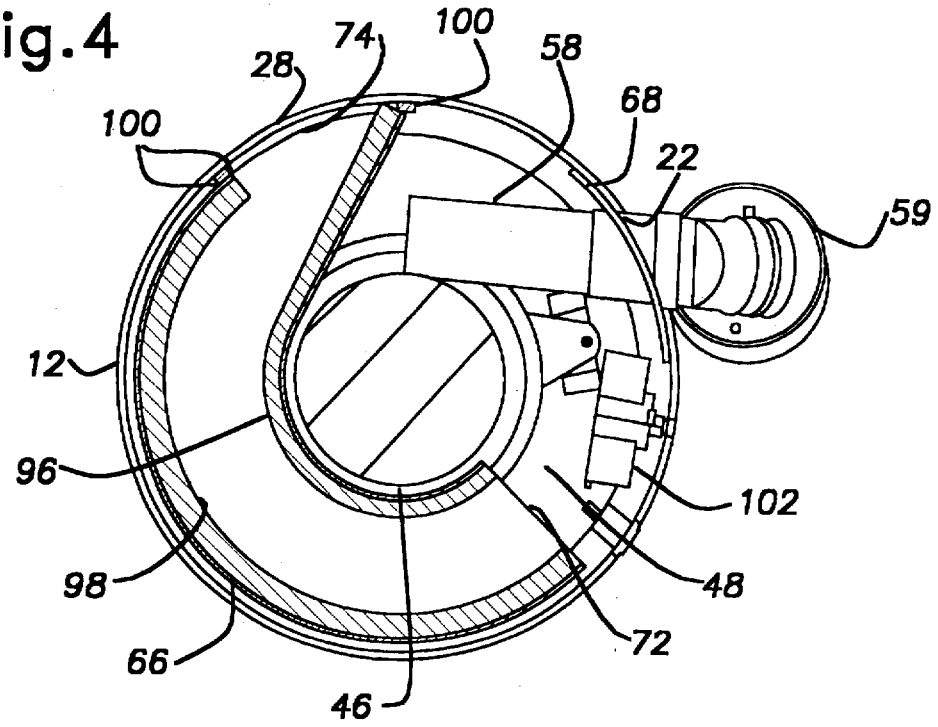
FIG. 4 is a cross-sectional plan view taken along line 4—4 of FIG. 2.

As best shown in FIGS. 2 and 4, the tunnel 66 is located within the upper interior chamber 48 for the purpose of reducing the amount of noise emitted from the cooling air outlet 28. The tunnel 66 has a first or inlet end 72 in fluid flow communication with upper interior chamber 48 and a second or outlet end 74 in fluid flow communication with the cooling air outlet 28.

Figure 5:
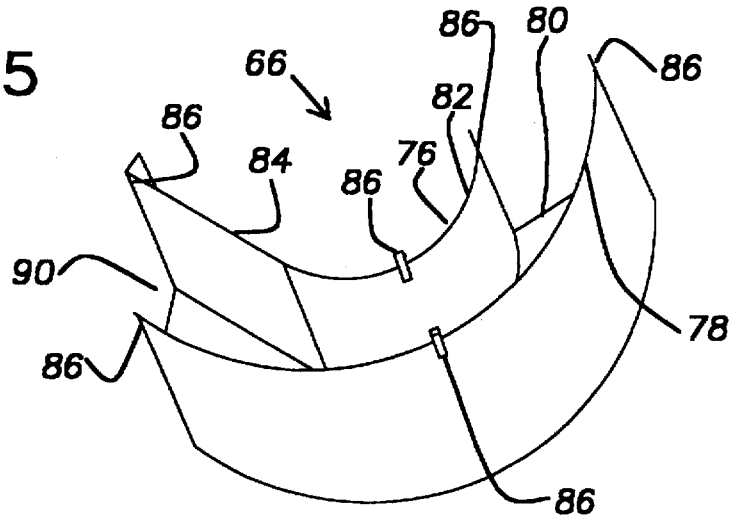
FIG. 5 is a perspective view of a tunnel of the central vacuum unit of FIG. 1.

As shown in FIG. 5, the tunnel 66 of the illustrated embodiment is generally U-shaped in cross-section having an inner wall 76, an outer wall 78, and a bottom wall 80 connecting the inner and outer walls 76, 78. The tunnel 66 is preferably molded from a plastic material such as, for example ABS plastic. The outer wall 78 is arcuate having a radius slightly less than the sidewall of the canister 12 and extends for approximately 180 degrees. The inner wall 76 has an arcuate portion 82 and a tangential portion 84. The arcuate portion 82 has a radius slightly greater than the outer surface of the vacuum motor 46 and extends for approximately 180 degrees. The tangential portion 84 is generally straight and extends from the arcuate portion 82 to the sidewall of the canister 12. The inner and outer walls 76, 78 are provided with resilient snap clips 86 which extend 4 through openings 88 (FIG. 3) in the lid 50 to secure the tunnel 66 to the lid 50 which both supports the tunnel 66 within the upper interior chamber 48 and closes the open top 90 of the tunnel 66.

The interior pathway formed by the tunnel 66 and the lid 50 is covered with sound absorbing material such as an open cell foam. As best shown in FIG. 2, a top foam element 92, a bottom element 94, and side elements 96, 98 are provided to surround the pathway defined within the tunnel 66. The foam elements 92, 94, 96, 98 are preferably at least ½ inch thick and preferably comprise a combustion modified polyether polyurethane material such as, for example, Char Hyfonic 1 which is available from Stephenson & Lawyer of Grand Rapids, Mich. As best shown in FIG. 4, foam elements 100 surround the outlet end 74 of the tunnel 66 to seal the outlet end 74 to the sidewall of the canister 12 so that sound is forced to follow the designed pathway through the tunnel 66 to exit through the cooling air outlet 28. As the noise passes through the tunnel 66, the noise is absorbed by the sound absorbing material.

The tunnel 66 is most effective at reducing emitted noise if the tunnel 66 has the greatest length and width allowed by the available space within the upper interior chamber 48 and allowed by heat restrictions. A longer tunnel 66 forces the noise to travel a longer path past the sound absorbing material so that more sound can be absorbed and a wider tunnel 66 allows the use of a thicker layer of sound absorbing material which yield more noise reduction. Therefore, various electrical components 102 within the upper interior chamber 48 are preferably located near the exhaust port 22 so that the tunnel 66 can circumferentially extend for substantially the entire distance around the vacuum motor 46 except for the space occupied by the exhaust pipe 58 and the electrical components 102 as best shown in FIG. 4. It can also be seen in FIG. 4 that the width of the tunnel 66 extends substantially from the sidewall of the canister 12 to the exterior surface of the vacuum motor 46. It is noted that while the pathway formed by the illustrated tunnel 66 is generally arcuate or curved, other tunnels can form effective sound absorbing pathways of other shapes. The pathways should, however, include curves or turns so that the pathway's not entirely straight or linear. The pathway of the illustrated tunnel 66 includes a curve which extends for approximately 180 degrees.

Figure 6:
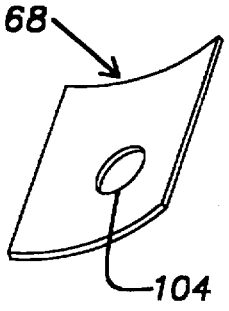
FIG. 6 is a perspective view of an exhaust port seal of the central vacuum unit of FIG. 1.

The exhaust port seal 68 reduces the amount of noise emitted from the exhaust port 22. As shown in FIG. 6, the exhaust port seal 68 is formed from a rectangular sheet of material which is generally arcuate to conform with the sidewall of the canister 12. The exhaust port seal 68 is preferably formed of a material with either a high transmission loss or a high absorption rate to either block or absorb sound that would otherwise be emitted from the upper interior chamber 48 through the exhaust port 22. The exhaust port seal preferably comprises a flexible foam such as, for example, 8443 Neoprene blend which is available from Lundell Manufacturing of Minneapolis, Minn. The exhaust port seal 68 forms a circular opening 104 for the exhaust pipe 46. The opening 104 is sized for an interference fit with the exhaust pipe 58 to provide a seal between the exhaust pipe 58 and the exhaust port seal 68. As best shown in FIG. 6, the exhaust port seal 68 is attached to the sidewall of the canister 12 with an adhesive to completely close the exhaust port 22.

Figure 7:
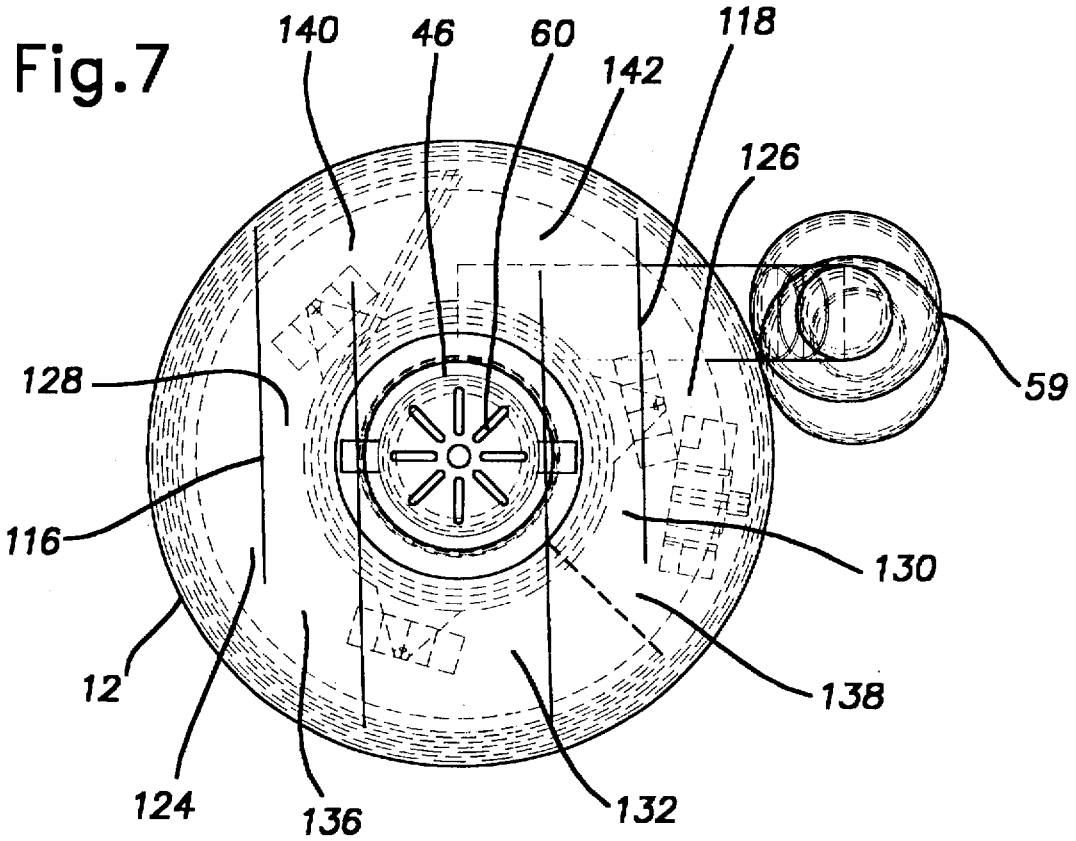
FIG. 7 is a cross-sectional plan view taken along line 7—7 of FIG. 2.
Figure 8:
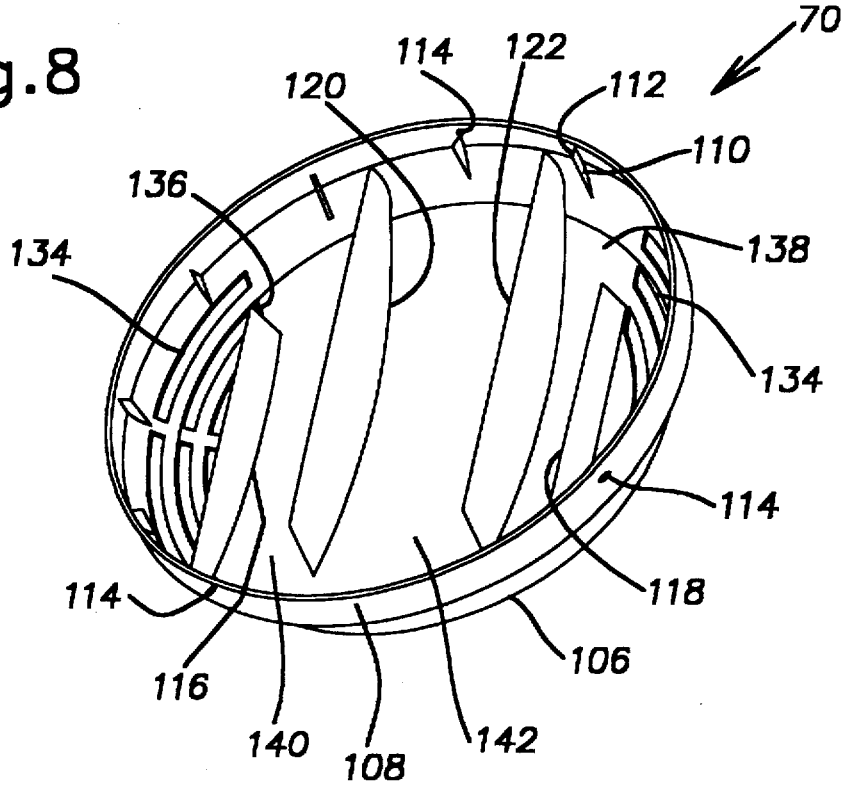
FIG. 8 is a perspective view of an acoustic damping canopy of the central vacuum unit of FIG. 1.

As best shown in FIGS. 2 and 7, the canopy 70 is attached to the top of the central vacuum unit 10 and encloses the cooling air inlet 60 of the vacuum motor 46 to reduce the noise emitted from the cooling air inlet 60. The canopy 70 is preferably molded of a plastic material such as, for example, an ABS plastic. As best shown in FIG. 8, the canopy 70 has a dome portion 106 and a cylindrically-shaped side portion 108. A plurality of ribs 110 extend inwardly from the side portion 108 and provide a plurality of abutments 112 for engaging the lid 50 to support the canopy 70 on the lid 50. Additionally, a plurality of fastener openings 114 are provided in the side portion for accepting fasteners which attach the canopy 70 to the canister 12.

Parallel and spaced-apart dividing walls 116, 118, 120, 122 extend from the dome portion 106 and the side portion 108 within the canopy 70. When the canopy 70 is attached to the canister 12, the lid and canopy 12 forms a pair of outer chambers or sections 124, 126, a pair of intermediate chambers or sections or 128, 130, and a central chamber or section 132, as best shown in FIG. 7. Openings or slots 134 are provided in the dome portion 106 at each of the outer sections 124, 126 so that the outer sections 124, 126 are in fluid communication with the exterior of the canopy 70 when the canopy 70 is attached to the canister 12. The outer walls 116, 118 each form a passage 136, 138 at a first end so that the outer sections 124, 126 are in fluid communication with the intermediate chambers 128, 130 at the first end. The inner walls 120, 122 each form a passage 140, 142 at a second end, opposite the passages 136, 138 of the outer walls 116, 188, so that the intermediate sections 128, 130 are in fluid communication with the central chamber 132. The central chamber 132 is in fluid communication with the cooling air inlet 60 of the vacuum motor 46 as best shown in FIG. 7.

As best shown in FIG. 2, a layer of sound absorbing foam 144 is located between the canopy 70 and the lid 50. The layer of foam 144 includes a central opening 146 (FIG. 3) for the cooling air inlet 60 of the vacuum motor 46. The foam layer 144 is preferably at least ½ inch thick and preferably comprises a combustion modified polyether polyurethane material such as, for example, Char Hyfonic 1 which is available from Stephenson & Lawyer of Grand Rapids, Mich. The layer of sound absorbing foam 144 both absorbs sound and seals the pathway between the sections 124, 126, 128, 130 of the canopy 70 so that sound is forced to follow the designed serpentine-shaped pathway of the canopy 70. Each of the serpentine pathways of the illustrated canopy 70 includes two 180 degree turns. The canopy 70 is designed so that noise from the motor cooling fan must travel through the serpentine-shape pathway of the canopy 70 past the layer of foam 144 before exiting through the slots 134. It is noted that additional sound absorbing foam can be added to the top and/or sides of the serpentine passageway. However, the additional foam only increases the noise reduction of the canopy 70 by about 1 db. It is noted that the serpentine pathway formed by the canopy 70 can form effective sound absorbing pathways of other shapes. A serpentine pathway is defined herein as a pathway including at least one curve or at least one turn so that the pathway not entirely straight or linear.

The acoustic damping system described hereabove is effective to substantially reduce the noise level of the central vacuum unit 10. For example, in the embodiment described hereabove, the overall noise level of the central vacuum unit 10 was reduced about 10 db with the most significant reductions of about 13 db, about 12 db, and about 12 db occurring in the 1,000 Hz, 2,000 Hz, and the 4,000 Hz octave bands respectively.

Although particular embodiments of the invention have been described in detail, it will be understood that the invention is not limited correspondingly in scope, but includes all changes and modifications coming within the spirit and terms of the claims appended hereto.

What is claimed is:

1. A central vacuum unit comprising:

a canister having a sidewall forming a hollow interior;

a vacuum motor within said canister which emits noise during operation;

at least one opening in said sidewall of said canister; and an acoustic damping tunnel within said hollow interior and forming a pathway between said hollow interior and said opening, said tunnel having an inlet end in fluid flow communication with said hollow interior and an outlet end surrounding said opening and sealed to said sidewall around said opening, said pathway being lined with a sound absorbing material, whereby said tunnel reduces noise emitted from said hollow interior through said opening.

2. The central vacuum unit according to claim 1, wherein said at least one opening is a plurality of slots.

3. The central vacuum unit according to claim 2, wherein said opening is a cooling air outlet for said motor.

4. The central vacuum unit according to claim 1, further comprising a lid closing one end of the sidewall and wherein said tunnel is U-shaped in cross-section having an inner wall adjacent said vacuum motor, an outer wall adjacent said sidewall of said canister, and a bottom wall integrally connecting said inner wall and said outer wall, said lid supporting said tunnel and closing a top end of said tunnel opposite said bottom wall.

5. The central vacuum unit according to claim 4, wherein said tunnel is secured to said lid with resilient snap clips.

6. The central vacuum according to claim 1, wherein said sound absorbing material is an open cell foam.

7. The central vacuum according to claim 6, wherein said open cell foam comprises combustion modified polyether polyurethane foam.

8. A central vacuum unit comprising:

a canister forming a hollow interior;

a vacuum motor within said canister which emits noise during operation;

at least one opening in said canister; and an acoustic damping canopy outside said canister and covering said opening, said canopy having at least one inlet and parallel and spaced-apart dividing walls forming a serpentine pathway between said opening and said inlet to reduce noise emitted from said hollow interior through said opening and said inlet.

9. The central vacuum unit according to claim 8, wherein said canister has a side wall and a lid closing an end of the canister, and said at least one opening is a cooling air inlet of said motor formed in said lid, said dividing walls cooperating with said lid to form said serpentine pathway.

10. The central vacuum unit according to claim 9, wherein a layer of sound absorbing material is provided between said lid and said canopy.

11. The central vacuum according to claim 10, wherein said sound absorbing material is an open cell foam.

12. The central vacuum according to claim 11, wherein said open cell foam comprises combustion modified polyether polyurethane foam.

13. The central vacuum unit according to claim 8, wherein said canopy comprises molded plastic.

14. A central vacuum unit comprising:

a canister having a sidewall forming a hollow interior and a lid closing one end of the sidewall;

a vacuum motor within said canister which emits noise during operation;

at least one cooling air inlet for admitting cooling air into said hollow interior;

at least one cooling air outlet in said sidewall for exhausting the cooling air from said hollow interior; and an acoustic damping tunnel within said hollow interior and forming a pathway between said hollow interior and said cooling air outlet, said tunnel having an inlet end in fluid flow communication with said hollow interior and an outlet end surrounding said cooling air outlet and sealed around said sidewall, said pathway being lined with a sound absorbing material, whereby said tunnel reduces noise emitted from said hollow interior through said cooling air outlet.

15. The central vacuum unit according to claim 14, wherein said tunnel is U-shaped in cross-section having an inner wall adjacent said vacuum motor, an outer wall adjacent said sidewall of said canister, and a bottom wall integrally connecting said inner wall and said outer wall, said lid supporting said tunnel and closing a top end of said tunnel opposite said bottom wall.

16. The central vacuum unit according to claim 15, wherein said tunnel is secured to said lid with resilient snap clips.

17. The central vacuum according to claim 14, wherein said sound absorbing material is an open cell foam.

18. A central vacuum unit comprising:

a canister having a sidewall forming a hollow interior and a lid closing one end of the sidewall;

a vacuum motor within said canister which emits noise during operation;

at least one cooling air inlet for admitting cooling air into said hollow interior;

at least one cooling air outlet in said sidewall for exhausting the cooling air from said hollow interior;

an acoustic damping tunnel within said hollow interior and forming a pathway between said hollow interior and said cooling air outlet, said pathway being lined with a sound absorbing material, whereby said tunnel reduces noise emitted from said hollow interior through said cooling air outlet; and an acoustic damping canopy over said lid and covering said cooling air inlet, said canopy having at least one inlet and forming a serpentine pathway between said cooling air inlet and said canopy inlet to reduce noise emitted from said hollow interior through said cooling air inlet and said canopy inlet.

19. The central vacuum unit according to claim 18, wherein sound absorbing material is provided along at least a portion of said serpentine pathway of said canopy.

20. The central vacuum unit according to claim 19, wherein said sound absorbing material along said serpentine pathway is an open cell foam.

21. A central vacuum unit comprising:

a canister having a sidewall forming a hollow interior and a lid closing one end of the sidewall, wherein said canister has an exhaust pipe port;

a vacuum motor within said canister which emits noise during operation and has an exhaust pipe extending through said exhaust pipe port;

at least one cooling air inlet for admitting cooling air into said hollow interior;

at least one cooling air outlet in said sidewall for exhausting the cooling air from said hollow interior; and an acoustic damping tunnel within said hollow interior and forming a pathway between said hollow interior and said cooling air outlet, said pathway being lined with a sound absorbing material, whereby said tunnel reduces noise emitted from said hollow interior through said cooling air outlet; and a seal which seals the exhaust pipe port to reduce noise emitted from the hollow interior through the exhaust pipe port.

22. The central vacuum unit according to claim 21, wherein said seal which seals said exhaust pipe port comprises flexible foam.

23. The central vacuum unit according to claim 1, wherein said tunnel circumferentially extends around said vacuum motor for less than the entire distance around said vacuum motor.

24. The central vacuum unit according to claim 23, wherein said inlet end of said tunnel is about 180 degrees from said outlet end of said tunnel.

25. The central vacuum unit according to claim 14, wherein said tunnel circumferentially extends around said vacuum motor for less than the entire distance around said vacuum motor.

26. The central vacuum unit according to claim 25, wherein said inlet end of said tunnel is about 180 degrees from said outlet end of said tunnel.

27. The central vacuum unit according to claim 14, further comprising at least one opening in said sidewall separate from said cooling air outlet for vacuum exhaust from said vacuum motor.

* * * * *